US009447564B2

(12) United States Patent
Kunz

(10) Patent No.: US 9,447,564 B2
(45) Date of Patent: Sep. 20, 2016

(54) WEAR MEMBER

(71) Applicant: Caterpillar Inc., Peoria, IL (US)

(72) Inventor: Phillip J. Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 153 days.

(21) Appl. No.: 14/272,097

(22) Filed: May 7, 2014

(65) Prior Publication Data

US 2014/0360060 A1 Dec. 11, 2014

Related U.S. Application Data

(60) Provisional application No. 61/833,111, filed on Jun. 10, 2013.

(51) Int. Cl.
*E02F 9/28* (2006.01)

(52) U.S. Cl.
CPC ..... *E02F 9/2833* (2013.01); *E02F 9/2883* (2013.01)

(58) Field of Classification Search
CPC ... E02F 9/2808; E02F 9/2816; E02F 9/2858; E02F 9/2883
USPC ..... 37/452, 455
See application file for complete search history.

(56) References Cited

U.S. PATENT DOCUMENTS

| | | | | |
|---|---|---|---|---|
| 2,874,491 | A * | 2/1959 | Larsen | E02F 9/2833 37/455 |
| 6,477,796 | B1 * | 11/2002 | Cornelius | E02F 9/2825 37/452 |
| 7,596,895 | B2 | 10/2009 | Jones et al. | |
| 9,091,042 | B2 * | 7/2015 | Guimaraes | E02F 9/2833 |
| 2009/0304442 | A1 * | 12/2009 | Dennis | E02F 9/2833 403/374.1 |
| 2013/0008062 | A1 | 1/2013 | Guimaraes et al. | |
| 2014/0360061 | A1 * | 12/2014 | Kunz | E02F 9/2833 37/455 |

OTHER PUBLICATIONS

CQMS Razer—"Shrouds", n.d. Retrieved from http://www.cqmsrazer.com/products/dragline-get/shrouds/ Apr. 22, 2014.

* cited by examiner

*Primary Examiner* — Gary Hartmann
(74) *Attorney, Agent, or Firm* — Bart A. Fisher; Timothy A. Parker

(57) ABSTRACT

A wear member including a body including a leg having an inner face and a first pocket formed in the inner face of the leg. A second pocket may be formed in the inner face of the leg and spaced apart from the first pocket by a passage extending between the first pocket and the second pocket in a direction parallel to a main axis of the body. The second pocket may include a curved abutment surface generally facing away from the first pocket.

11 Claims, 14 Drawing Sheets

WEAR MEMBER

CROSS-REFERENCE TO RELATED APPLICATION

This application claims the benefit of U.S. Provisional Patent Application No. 61/833,111, filed Jun. 10, 2013, which is hereby incorporated by reference in its entirety.

TECHNICAL FIELD

The present disclosure relates generally to a wear assembly for a work implement. More particularly, the present disclosure may relate to a mechanism for retaining a wear member on a bucket.

BACKGROUND

Many construction and mining machines, such as excavators, wheel loaders, hydraulic mining shovels, cable shovels, bucket wheels, and draglines make use of buckets to dig material out of the earth. The buckets can be subjected to extreme wear from the abrasion and impacts experienced during digging. Other construction and mining machines, such as bulldozers, also include blades or other tools that are used to move material such as soil and rock. These blades and other tools can also be subjected to extreme wear through abrasion and other wear mechanisms.

Buckets and blades and other earth-working tools can be protected against wear by including ground engaging tools (GET). GET is typically fashioned as teeth, edge protectors, and other components which are attached to the bucket or blade in the area where the most damaging abrasion and impacts occur. For example, the cutting edge of a bucket can be protected with edge protectors that wrap around and protect the edge.

Thus, one purpose of the GET is to serve as wear material and absorb wear that would otherwise occur on the bucket, blade, or other tool. The GET can be removed when it has been worn and replaced with new GET at a reasonable cost to continue to protect the bucket. Large buckets for draglines and hydraulic shovels can cost a considerable amount, so protecting them against wear and the need for early replacement is important. It is more economical to wear out and replace the GET than to wear out and replace an entire bucket.

In the case of buckets, a lip may be provided on a leading edge of the bucket. The bucket lip may include one or more noses projecting outwardly and configured to receive a replaceable tip thereon. A shroud may also be provided between the noses to protect the intermediate portion of the bucket lip. Additional types of wear members may be provided on the bucket to increase wear protection, including, for example, heel shrouds and mechanically attached wear plates. Because the wear members may be designed to be replaced after a period of use, and may therefore be secured to the bucket lip by a releasable retention system. Many retention systems are designed to be hammerless, meaning a hammer is not required to release the retention system.

U.S. Pat. No. 7,596,895, assigned to ESCO Corporation, discloses a wear assembly to protect the front edge of an excavating bucket including a wear member having a pair of legs designed to straddle a bucket lip. One of the legs includes an axial slot with opposing grooves for receipt of rails on a boss fixed to the bucket. A wear member retention system available from CQMS RAZER (Brisbane, Australia) includes a bolt configured to retain a wear member to a bucket lip. Many other wear member retention systems are known in the art, however existing retention systems can be complicated, difficult to release for replacement of wear members, or expensive, and therefore offer opportunities for improvement.

The wear assembly and retention system of the present disclosure alleviates one or deficiencies of the prior art.

SUMMARY OF THE INVENTION

One aspect of the present disclosure is directed to a wear member including a body including a leg having an inner face; a first pocket formed in the inner face of the leg; a second pocket formed in said inner face and spaced apart from the first pocket by a passage extending between the first pocket and the second pocket in a direction parallel to a main axis of the body, the second pocket including a curved abutment surface generally facing away from the first pocket.

Another aspect of the present disclosure is directed to a wear member including a first leg and second leg defining a slot therebetween and converging at a front end, the slot configured to receive a lip of a bucket and the first leg having an inner face defining a first pocket configured to receive a boss therein and a second pocket, the second pocket including a curved abutment surface generally facing the front end and having a width $W_3$; and a partition between the first and second pockets, the partition defining a passage between the first pocket and second pocket, the passage having a width $W_4$, wherein the ratio of the width $W_3$ of the second pocket to the width $W_4$ of the passage is greater than 2.0.

Another aspect of the present disclosure is directed to a wear member including a front end defining a front edge; a first leg extending rearward from the front end; a second leg extending rearward from the front end and spaced from the first leg to define a slot therebetween; a first pocket formed in an inner face of the first leg; a second pocket a second pocket formed in said inner face and spaced from the first pocket along a main axis of the first leg, the second pocket including a curved abutment surface generally facing the front end, the curved abutment surface having a generally constant radius and extending greater than 180° around a center of the circle; and a partition between the first and second pockets, the partition defining a passage extending between the first pocket and second pocket.

DETAILED DESCRIPTION

Figure 1:
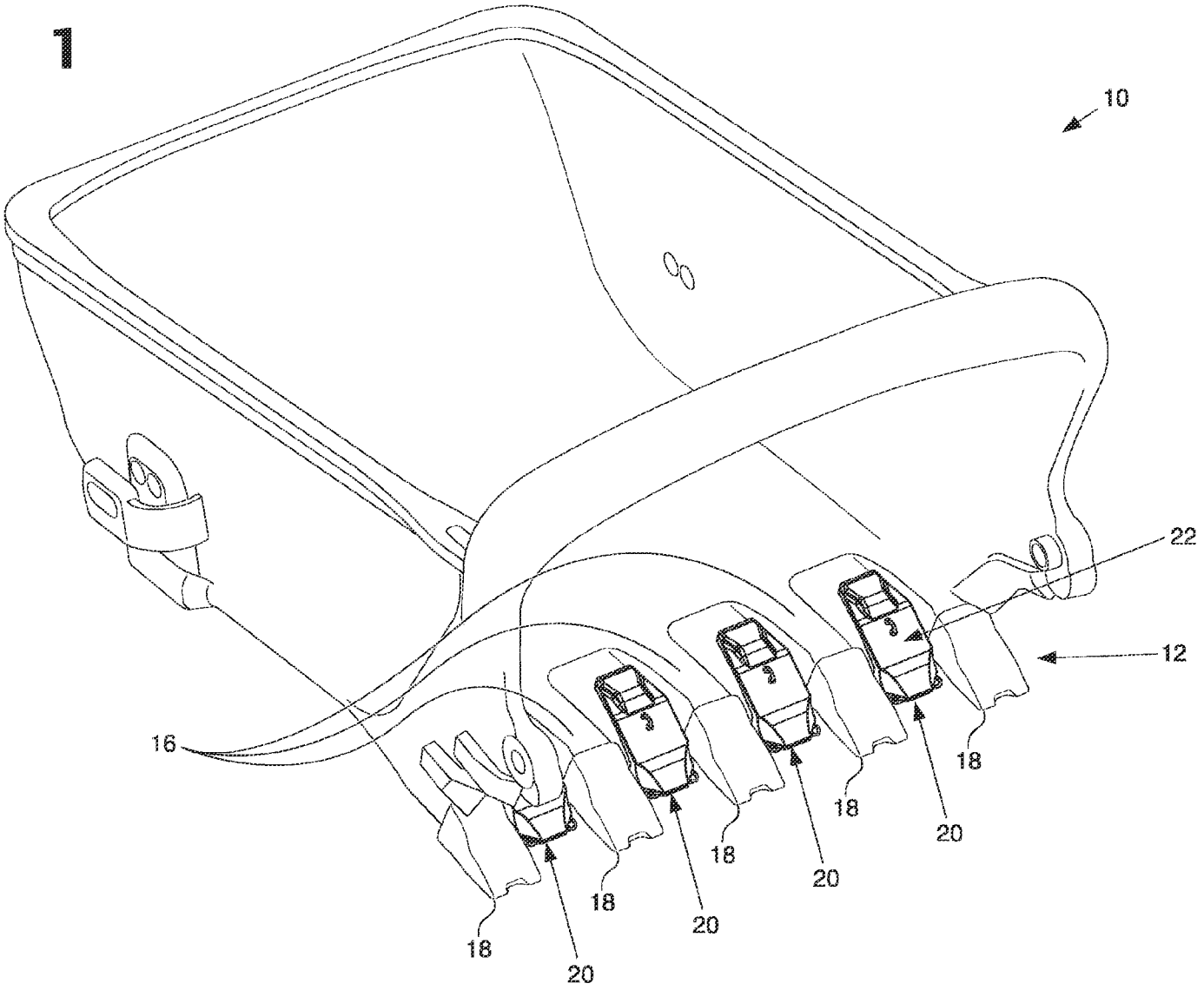
FIG. 1 is a perspective view of an exemplary bucket and wear assembly according to the concepts of the present disclosure.
Figure 2:
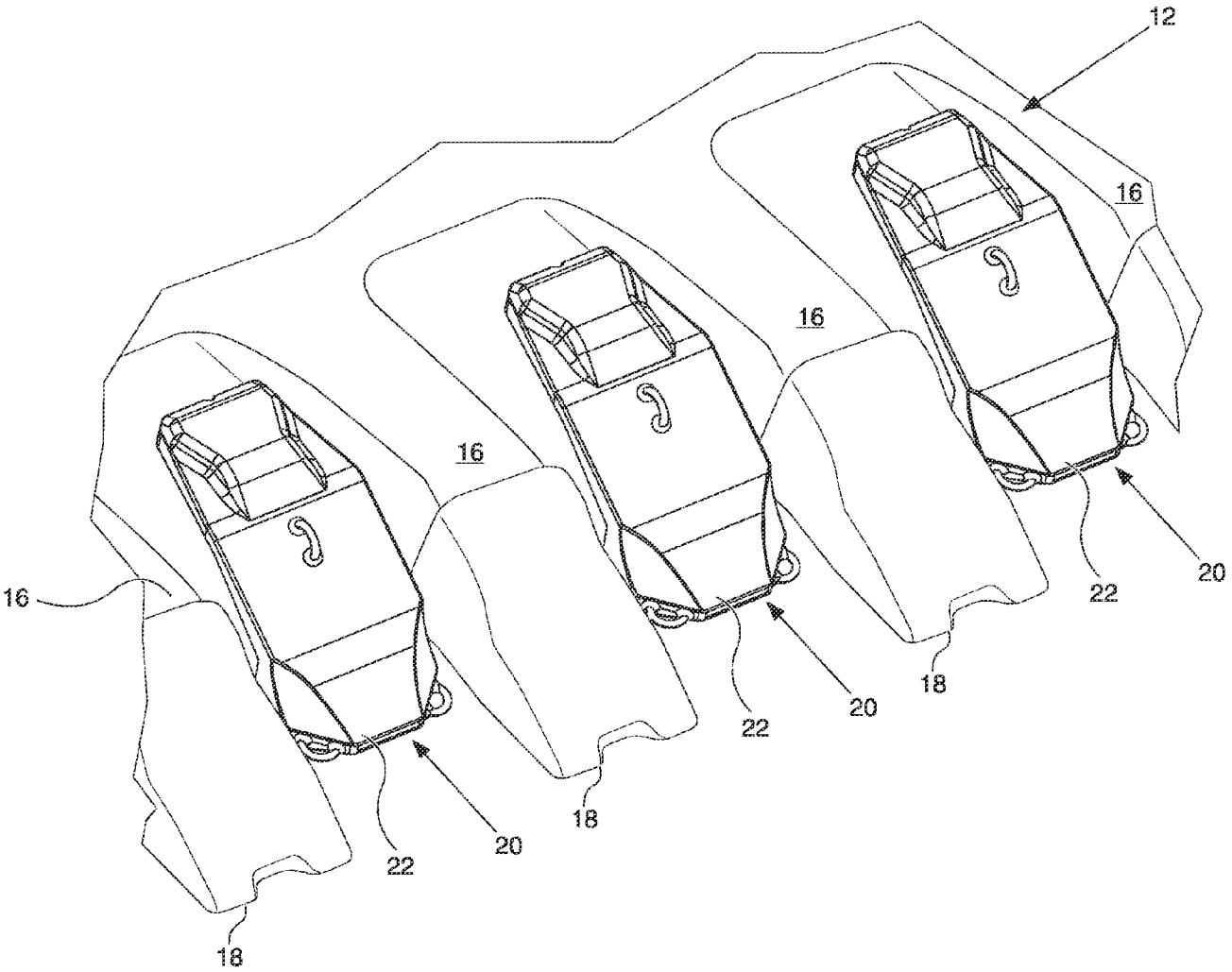
FIG. 2 is an enlarged fragmentary view of the wear assembly of FIG. 1.
Figure 3:
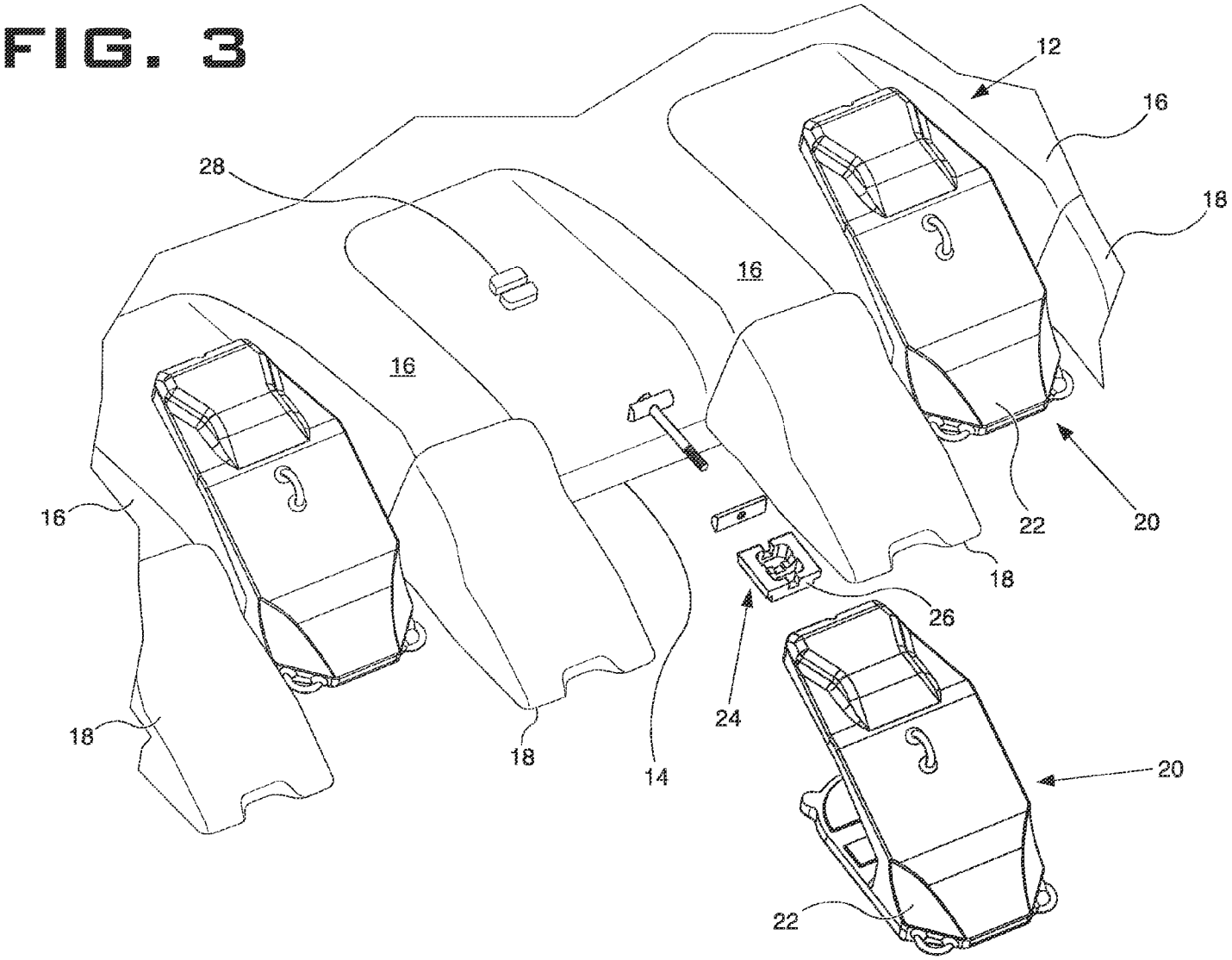
FIG. 3 is an exploded view of the wear assembly of FIG. 2.

Referring now to FIGS. 1-3, an excavator bucket is shown and is indicated generally by the numeral 10. Bucket 10 may be attached to an excavator or other digging device, and may be configured to dig or excavate work material from a work site. The excavator bucket 10 may include a bucket lip 12, and the bucket lip may taper toward a leading edge 14 (FIG. 3). Bucket lip 12 may include a series of laterally spaced noses 16 along the leading edge 14, each nose 16 projecting forward from the leading edge 14.

A wear tip 18 may be secured on each nose 16 to protect against abrasion and prolong the life of bucket 10. The wear tips 18 may have a variety of outer geometries depending upon the intended use of the bucket 10 and the work material that the bucket 10 will contact. Wear tips 18 may be releasably secured to a nose 16 by a releasable tip retention system (not shown) configured to allow removal of the tip 18 from the nose 16. Many such tip retention systems are known, including numerous hammerless retention systems. It is also contemplated that an adapter (nose) may be secured over each nose 16, and the wear tips 18 secured to an adapter rather than being secured directly to the nose 16. The adapter may provide an additional layer of wear protection to the bucket lip 12.

A wear assembly 20 including a wear member 22 may be secured to bucket lip 12 over leading edge 14 between noses 16. In certain embodiments, bucket lip 12 may be recessed between noses 16 to accommodate wear member 22. Wear member 22, which may also be referred to as a shroud 22, protects the bucket lip 12 from abrasion between the laterally spaced noses 16 and wear tips 18. Wear member 22 may be secured to bucket lip 12 by a releasable retention system 24, thereby allowing for replacement of the wear member 22 after a period of use. The retention system 24 may provide positive retention, meaning the wear member 22 may be forced against the bucket lip 12 and/or leading edge 14 of the bucket by the retention system. This positive retention provided by the retention system 24 may help to reduce internal wear and increase the strength of the wear assembly 20.

A boss 26 may be secured to bucket lip 12 at a location between noses 16 and spaced from the leading edge 14. Boss 26 may be welded to bucket lip 12 or, alternatively, may be formed as an integral part of the bucket lip 12. In a particular embodiment, one or more protrusions 28 may be provided on bucket lip 12 to help secure and locate each boss 26. Boss 26 may also be welded to an otherwise planar portion of bucket lip 12.

Figure 5:
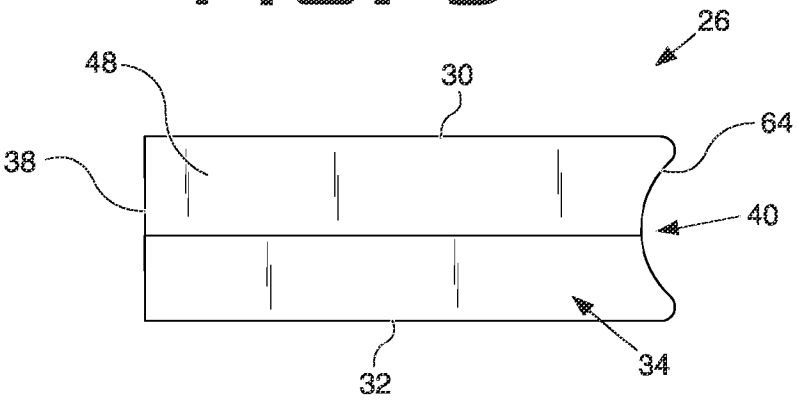
FIG. 5 is a side view of the boss of FIG. 4.
Figure 6:
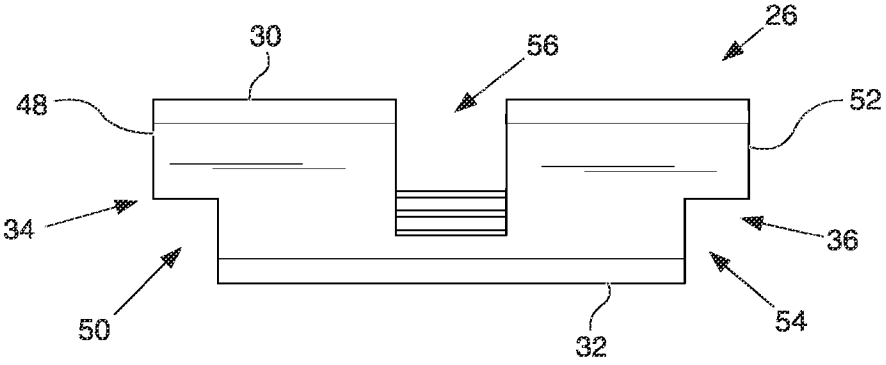
FIG. 6 is an end view of the boss of FIG. 4.
Figure 4:
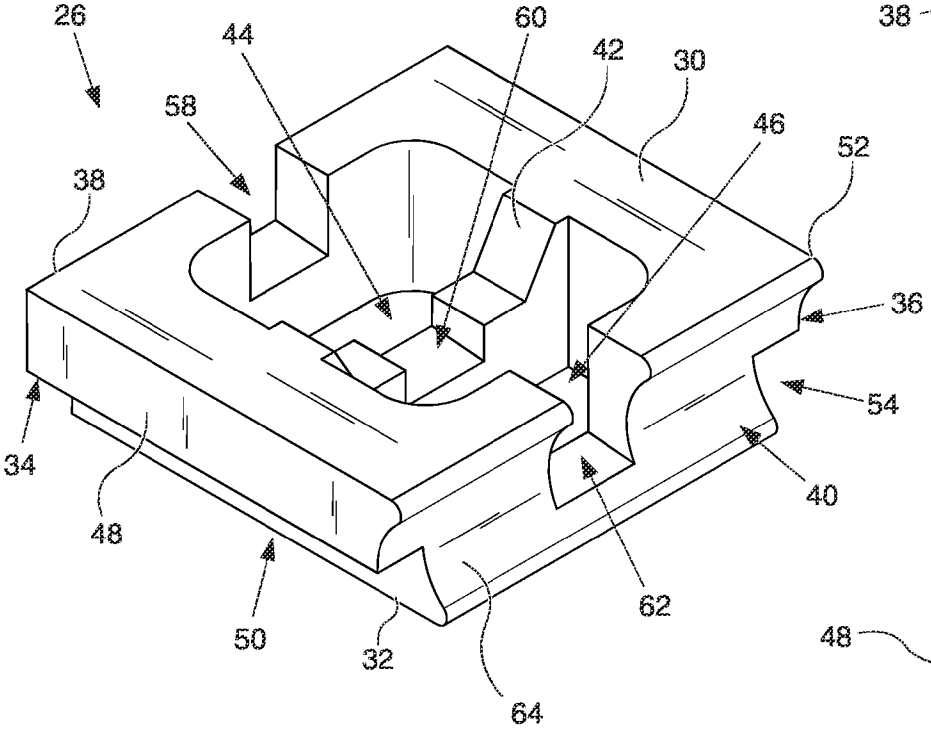
FIG. 4 is a perspective view of a boss according to the concepts of the present disclosure.

Boss 26 may be configured to engage and interact with the retention system 24 to retain the wear member 22 on the bucket lip 12. In an exemplary embodiment, as shown in FIGS. 4-6, boss 26 may be generally rectangular in shape with an upper surface 30, a lower surface 32 spaced from the upper surface, first and second sidewalls 34 and 36, a front wall 38 and a rear wall 40.

The upper and lower surfaces 30 and 32 may be generally planar and substantially parallel to one another. Alternatively, upper surface 30 and/or lower surface 32 may be shaped to intimately contact and engage the bucket lip 12 or other surfaces of the wear assembly 20. First and second sidewalls 34 and 36 may be laterally spaced from and substantially parallel to one another. Rear wall 40 and front wall 38 may extend between and may each be oriented generally perpendicular to the first and second sidewalls 34 and 36.

A cross member 42 may extend between first sidewall 34 and second sidewall 36. Cross member 42 may help to define a front opening 44 through boss 26 and a rear opening 46 through boss 26. Front opening 44 may extend through upper surface 30 and lower surface 32 and may be defined at the periphery by the front wall 38, portions of the first and second sidewalls 34 and 36 and cross member 42. Rear opening 46 may extend through upper surface 30 and lower surface 32 and may be defined at the periphery by the rear wall 40, portions of the first and second sidewalls 34 and 36 and cross member 42.

First sidewall 34 may include a laterally projecting first shoulder 48 adjacent upper surface 30 that defines a first slot 50 extending longitudinally along the length of boss 26. Similarly, second sidewall 36 may include a laterally projecting second shoulder 52 adjacent upper surface 30 that defines a second slot 54 extending longitudinally along the length of boss 26. Bucket lip 12 may form a bottom surface of both the first and second slots 50 and 54 formed by the first and second shoulders 48 and 52 when boss 26 is secured to the bucket lip 12.

A longitudinally extending fastener trough 56 may be formed in boss 26 by a front notch 58 in front wall 38, an intermediate notch 60 in cross member 42 and a rear notch 62 in rear wall 40. Each of the front notch 58, intermediate notch 60 and rear notch 62 includes an open upper end in upper surface 30. The front notch 58, intermediate notch 60 and rear notch 62 may be positioned on a common axis to form a generally linear trough 56 configured to receive a linear fastener of the retention system, as will be discussed in greater detail below. In a particular embodiment, each of the notches 58, 60 and 62 may have a generally U-shaped profile. The rear notch 62 may have a greater depth, measured from the upper surface 30, than the intermediate notch 60. Similarly, the intermediate notch 60 may have a greater depth, as measured from the upper surface 30, than the front notch 58. These varying depths of the notches 58, 60 and 62 may provide a trough 56 that is sloped from front to rear.

Rear wall 40 may include a curved abutment surface 64 facing generally opposite front wall 38. Curved abutment surface 64 may extend the entire width of rear wall 40 or, alternatively, may extend across only a portion of rear wall 40. The curved abutment surface 64, as shown in FIGS. 4 and 5 is concave, although it is also contemplated that the curved abutment surface of rear wall 40 may be convex. The radius of curvature of curved abutment surface 64 may be substantially constant or may vary to provide a compound curvature in rear wall 40.

Boss 26 may be secured on bucket lip 12 so that front wall 38 faces leading edge 14 of bucket lip 12, and rear wall 40 is therefore spaced further from leading edge 14 than front wall 38. Curved abutment surface 64 of boss 26 may face generally away from leading edge 14. Boss 26 may be secured to bucket lip 12 by a weld extending around the periphery of first and second sidewalls 34 and 36, front wall 38 and rear wall 40. Additionally, or alternatively, boss 26 may be secured to bucket lip 12 by a weld in front opening 44 and rear opening 46.

Figure 7:
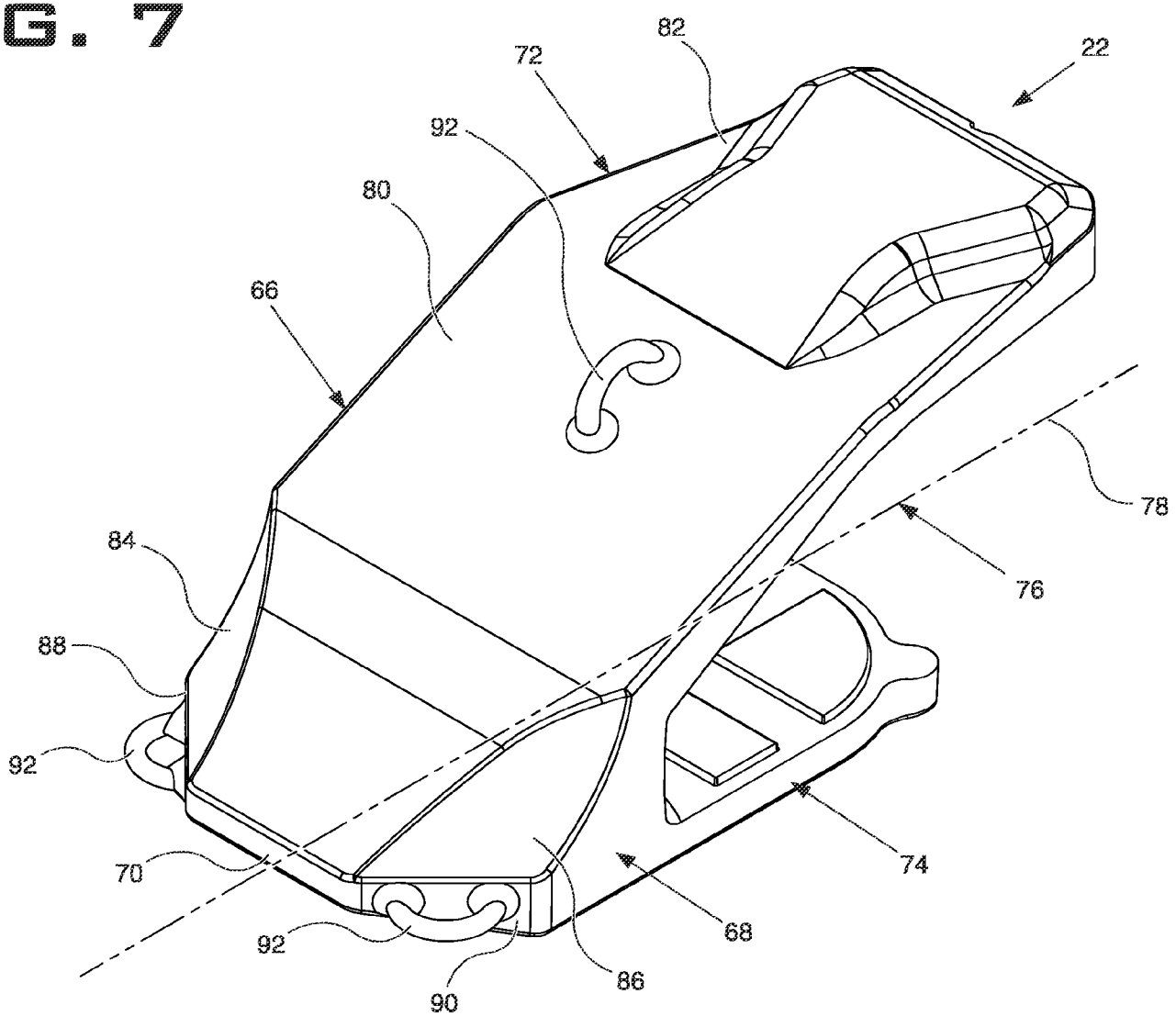
FIG. 7 is a top perspective view of a wear member according to the concepts of the present disclosure.
Figure 8:
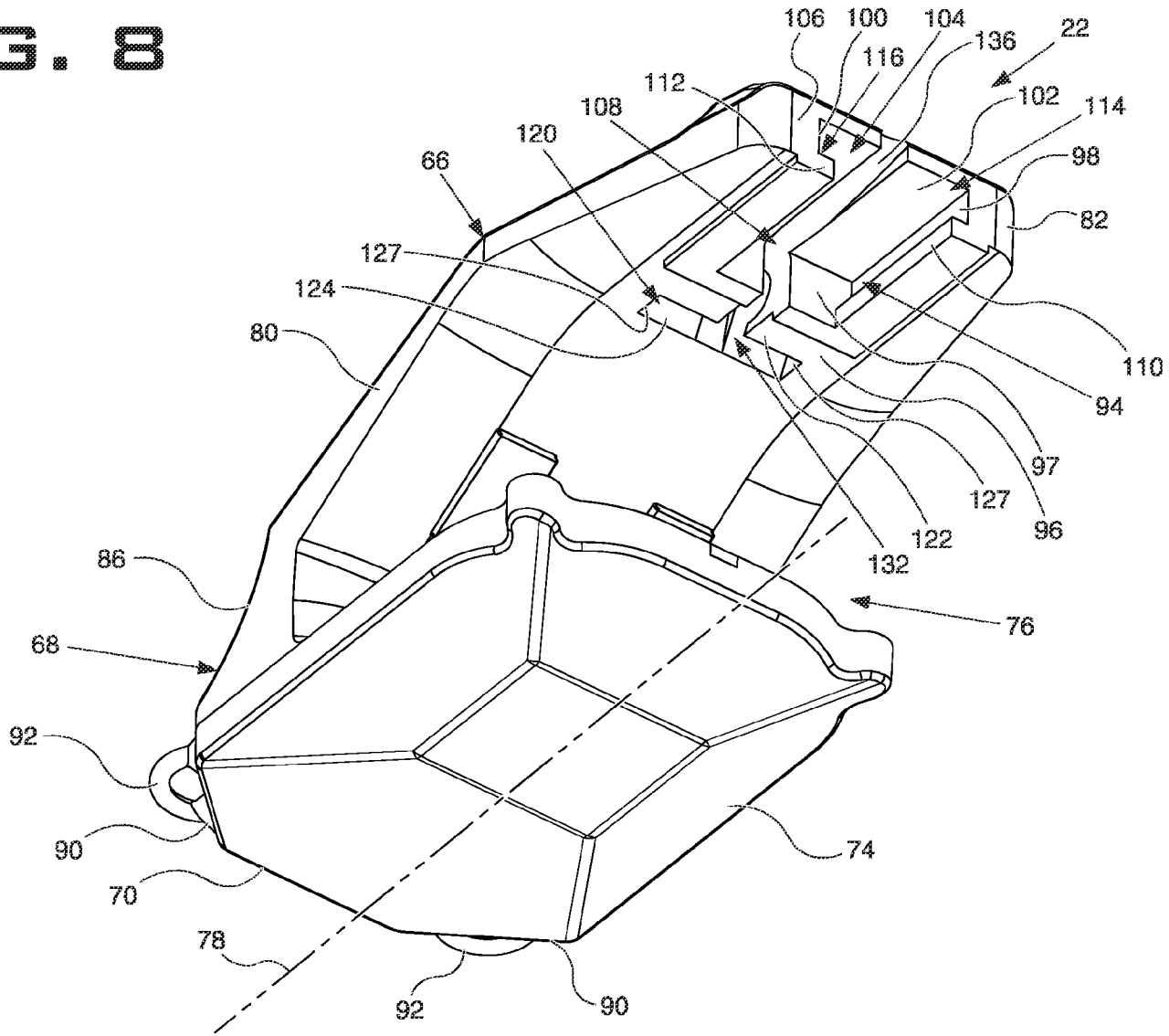
FIG. 8 is a bottom perspective view of the wear member of FIG. 7.
Figure 9:
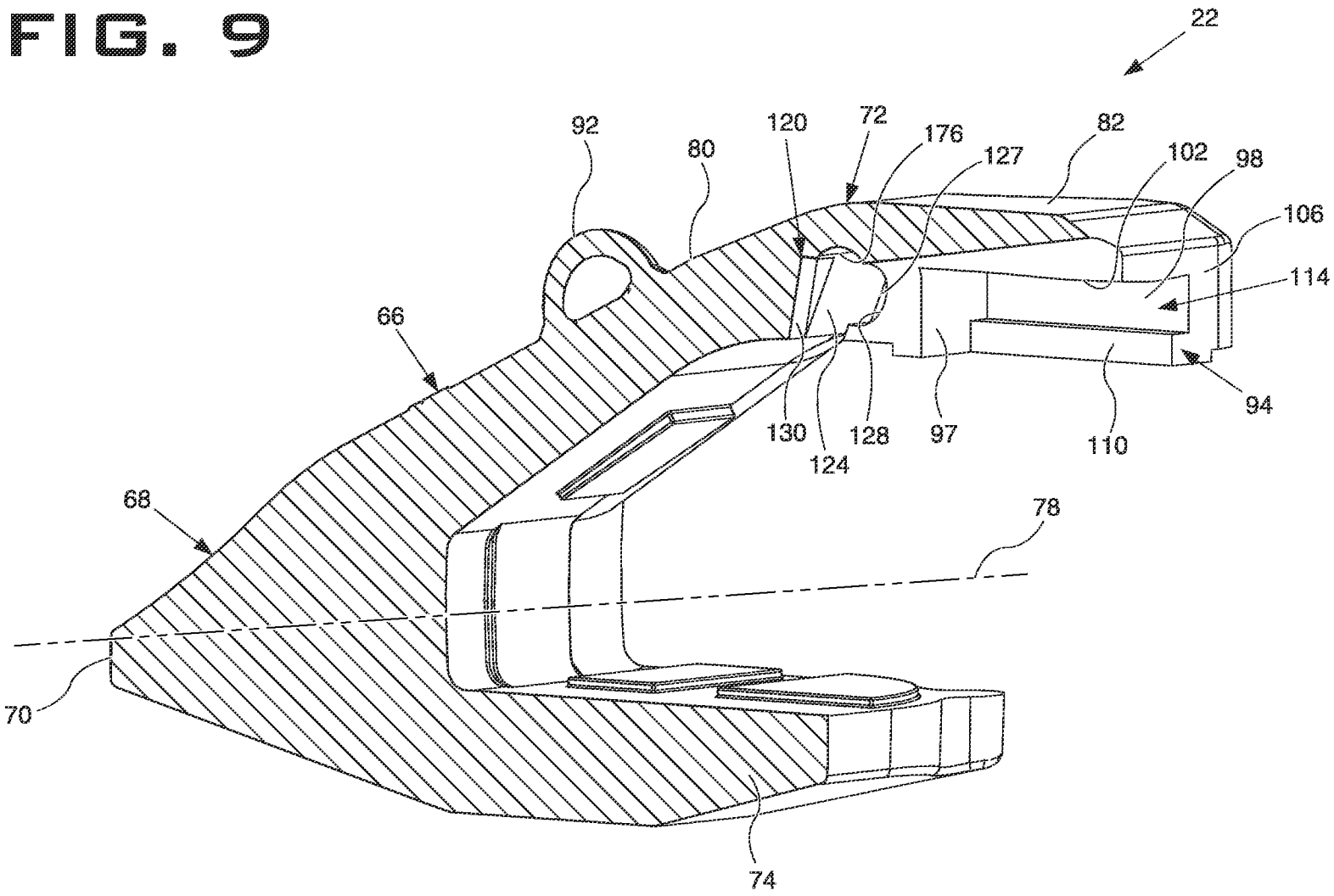
FIG. 9 is a cross section view of the wear member of FIG. 7.
Figure 10:
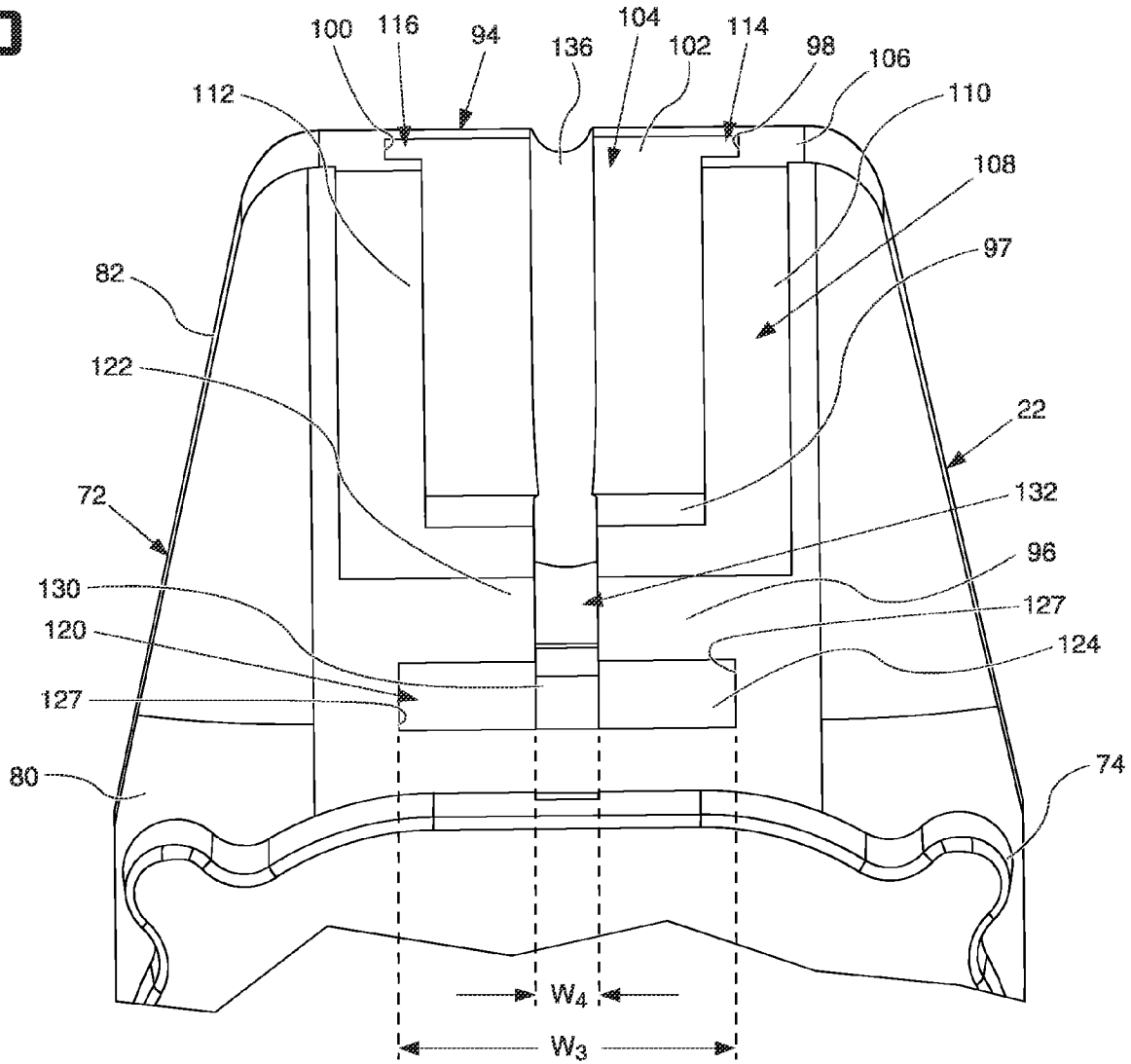
FIG. 10 is a rear view of the wear member of FIG. 7.
Figure 11:
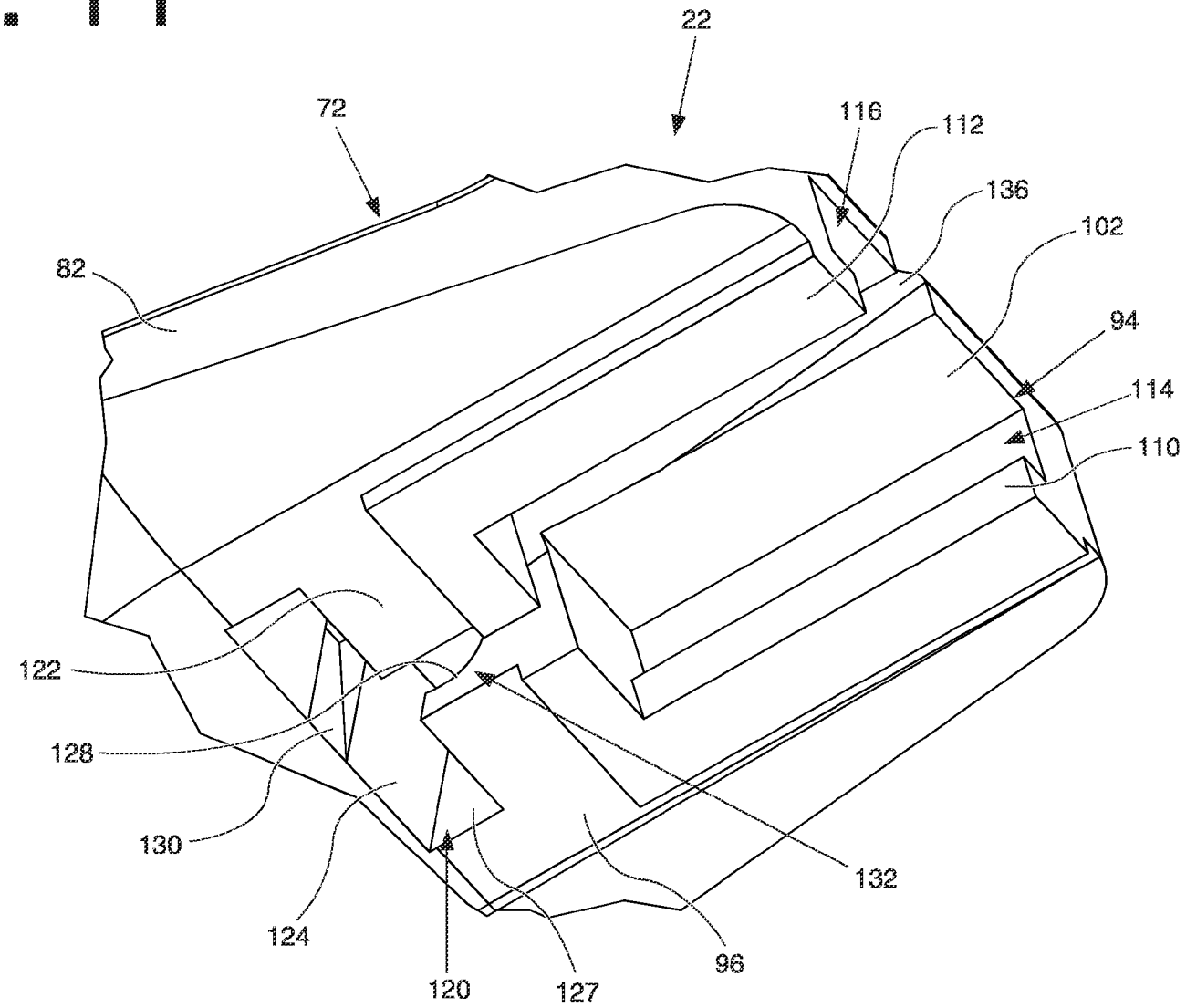
FIG. 11 is a bottom view of the inner face of the inner leg of the wear member of FIG. 7.

As best shown in FIGS. 7-9, wear member 22 may have a body 66 including a front end 68 defining a front edge 70, an inner or first leg 72 extending in a direction away from front edge 70 and an outer or second leg 74 extending in a direction away from front edge 70. First and second legs 72 and 74 are spaced from one another to define a lip receiving slot 76 therebetween. Wear member 22 may have a main axis 78 extending longitudinally from a front to a rear of the body 66 of wear member 22 in the direction of insertion of bucket lip 12. First leg 72 may be configured to be positioned on an interior side of the bucket lip 12 when wear member 22 is installed. Second leg 74 may be configured to be positioned on an exterior side of the bucket lip 12 when wear member 22 is installed.

In a particular embodiment, and as shown in FIGS. 7-9, first leg 72 may include a forward portion 80 and a tail portion 82. Forward portion 80 may be positioned on an axis angled upward relative to the main axis 78 of body 66 so as to extend away from second leg 74. Tail portion 82 may be positioned on an axis generally parallel to and spaced from main axis 78. Second leg 74 may be positioned on an axis generally parallel to main axis 78. First leg 72 may extend a greater distance from front end 68 than second leg 74.

Front end 68 of body 66 may include beveled edges, chamfers, cutouts and/or ridges in any desired combination. In the embodiment of the wear member 22 depicted in FIGS. 7-9, front end 68 includes first and second beveled surfaces 84 and 86 on opposing lateral sides adjacent to front edge 70. Front edge 70 may include chamfered corners 88 and 90 at opposing lateral sides thereof. One or more eye hooks 92 may extend outwardly from body 66 to facilitate lifting and installation or removal of wear member 22.

A first pocket 94 may be formed in an inner face 96 of tail portion 82 of first leg 72. First pocket 94 may be configured to receive boss 26 therein when wear member 22 is secured to bucket lip 12. First pocket 94 may include a front surface 97 facing generally away from front end 68, laterally opposed side surfaces 98 and 100, and a top surface 102 facing lip retaining slot 76. First pocket 94 may include an open rear 104 in a rear surface 106 of first leg 72 and an open bottom 108 in inner face 96.

First and second feet 110 and 112 may extend inward from side surfaces 98 and 100 toward one another adjacent inner edges of the side surfaces 98 and 100 to define laterally opposed first and second troughs 114 and 116 in first pocket 94. Troughs 114 and 116 may be sized and shaped to receive first and second shoulders 48 and 52 of boss 26, and feet 110 and 112 may be sized and shaped to be received in first and second slots 50 and 54. In a particular embodiment, the size and shape of first and second shoulders 48 and 52 and first and second feet 110 and 112 may allow for minimal space within first pocket 94 when boss 26 is received therein.

A second pocket 120 may be formed in inner face 96 of tail portion 82 of first leg 72. Second pocket may be longitudinally spaced from first pocket 94 along the main axis 78 of body 66 in a direction opposite rear surface 106 of first leg 72, with a partition wall 122 positioned therebetween. Second pocket 120 may include a front surface 124 generally facing first pocket 94, a top surface 126 (FIG. 9) generally facing lip receiving slot 76, laterally spaced side surfaces 127 and a curved abutment surface 128 (FIG. 9) generally facing away from first pocket 94.

Curved abutment surface 128 may be formed in partition wall 122, and in a particular embodiment may be concave so that it extends into partition wall 122. Curved abutment surface 128 may extend in a direction generally perpendicular to the main axis 78 of body 66 of wear member 22. In a particular embodiment, curved abutment surface 128 may have a constant radius of curvature and may extend at least 180° around a center axis. Top surface 126 of second pocket 120 may also be concave. A depression 130 may be formed in front surface 124 at approximately the lateral center thereof between side surfaces 127, and depression 130 may have a progressively increasing depth as it extends from inner face 96 into first leg 72. A passage 132 may be provided in partition wall 122 between first and second pockets 94 and 120. Passage 132 may be open at inner face 96 of first leg 72.

A recess 136 may be provided in the top surface 102 of first pocket 94, and may extend longitudinally from rear surface 106 of first leg 72 into passage 132 and the top surface 126 of second pocket 120. Recess 136 may be laterally centered within first leg 72, and may be laterally aligned with depression 130 formed in front surface 124 of second pocket 120. Recess 136 may have a progressively increasing depth as it approaches rear surface 106. Stated differently, recess 136 may have a greater depth proximate rear surface 106 than the depth proximate second pocket 120.

Figure 13:
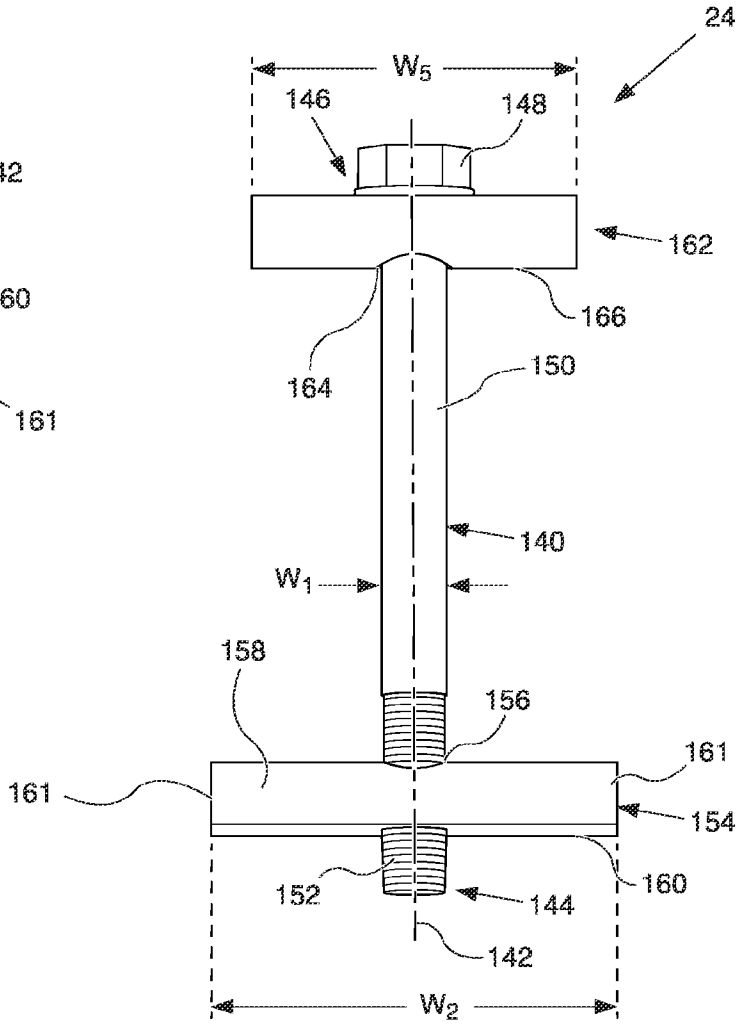
FIG. 13 is a top view of the retaining assembly of FIG. 10.
Figure 12:
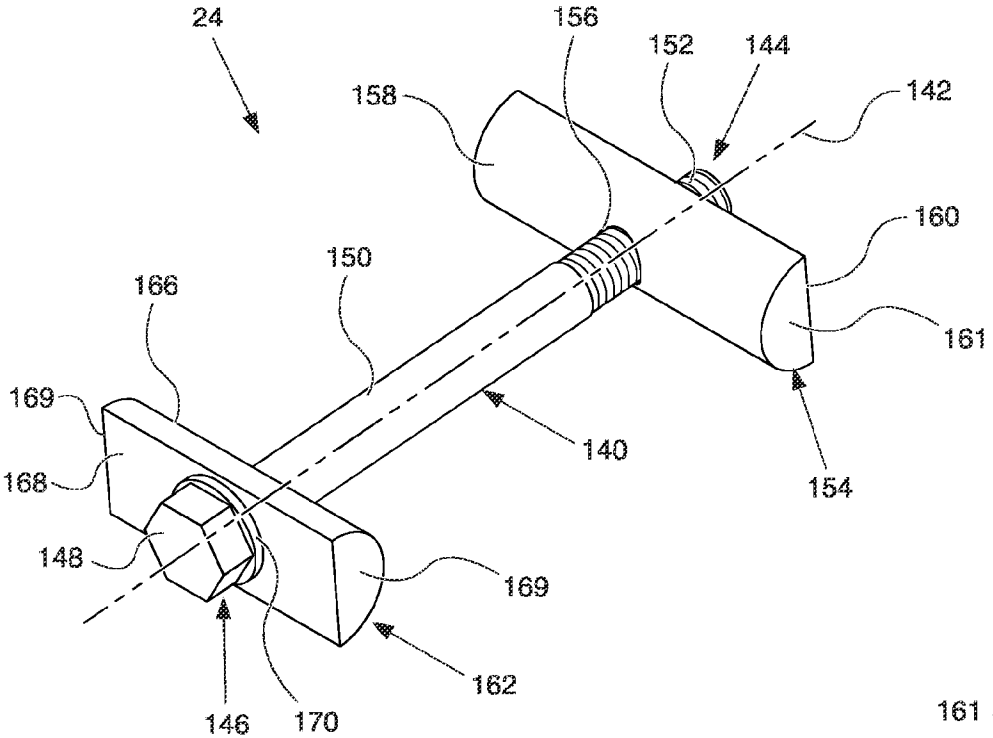
FIG. 12 is a perspective view of a retaining assembly according to the concepts of the present disclosure.
Figure 14:
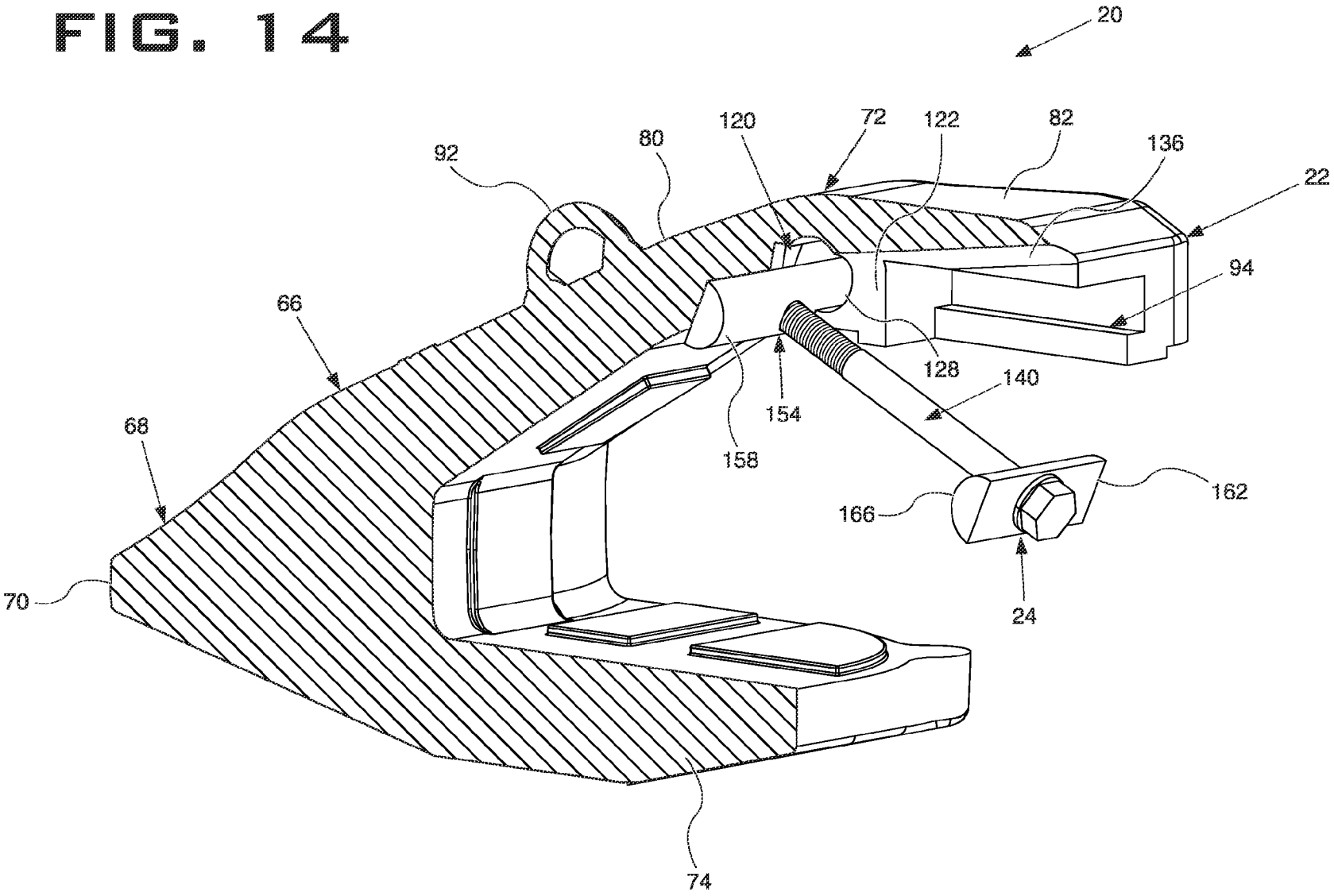
FIG. 14 is a fragmentary perspective cross section view of a wear member assembly according to the concepts of the present disclosure showing insertion of a retaining assembly into the wear member.

Referring now to FIGS. 12 and 13, the retention system 24 is shown in detail. Retention system 24 includes a fastener 140 having a longitudinal axis 142 extending from a first end 144 to a second end 146. Fastener 140 may include a head 148 at second end 146 that may act as a tool engagement interface. Accordingly, head 148 may be hexagonal in shape, or may be otherwise configured to engage a tool used to rotate fastener 140. A shank 150 may extend from head 148 to first end 144. Shank 150 may be generally cylindrical with a diameter $W_1$, but it is also contemplated that shank 150 may have other cross sectional profiles. A threaded portion 152 of shank 150 may be provided adjacent first end 144. Threaded portion 152 may extend along shank 150 any desired distance, and in a particular embodiment may extend along shank 150 between 5 and 50% of the total length of the shank.

Figure 19:
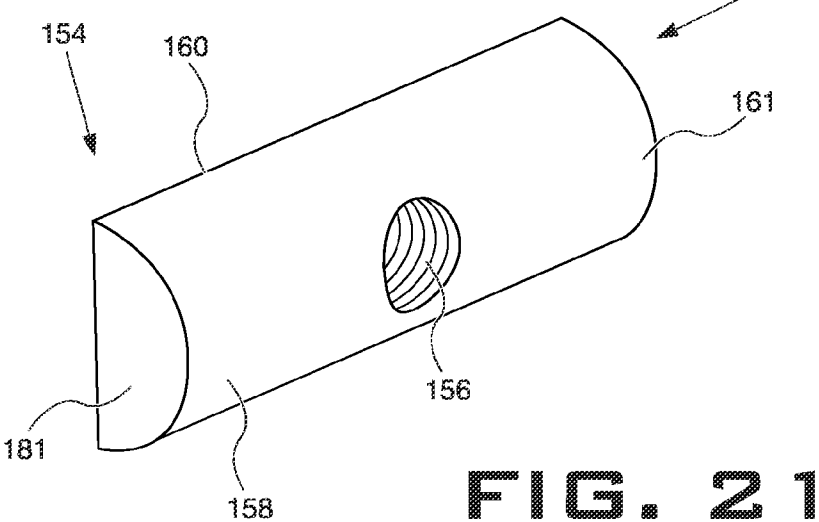
FIG. 19 is a perspective view of a retaining member according to the concepts of the present disclosure.

A first retaining member 154 may be removably secured over the threaded portion 152 of the shank 150. First retaining member 154 may include a threaded bore 156 extending therethrough, as best shown in FIG. 19; the threaded bore is adapted to engage the threaded portion 152 of the shank to removably secure the first retaining member thereto. First retaining member 154 may also include a curved abutment surface 158. Curved abutment surface 158 may be convex with a constant radius of curvature and a center axis generally parallel to the longitudinal axis of the first retaining member 154.

In a particular embodiment, first retaining member 154 may include a longitudinally extending planar surface 160 with the curved abutment surface 158 extending from opposing lateral edges of the planar surface 160 to form a retaining member having a semi-circular cross sectional profile. End surfaces 161 may be provided at opposing longitudinal ends of the first retaining member 154. The first retaining member 154 may be substantially straight along the longitudinal axis extending between the end surfaces 161. First retaining member 154 may have a width $W_2$ measured along a longitudinal axis thereof.

A second retaining member 162 may be removably secured over the shank 150. Second retaining member 162 may include a bore 164 extending therethrough, the bore 164 adapted to slide over the shank 150, including threaded portion 152. Second retaining member 162 may also include a curved abutment surface 166. Curved abutment surface 166 may be convex with a constant radius of curvature and a center axis generally parallel to the longitudinal axis of the second retaining member.

In a particular embodiment, second retaining member 162 may include a longitudinally extending planar surface 168 with the curved abutment surface 166 extending from opposing lateral edges of the planar surface 168 to form a retaining member having a semi-circular cross sectional profile. End surfaces 169 may be provided at opposing longitudinal ends of the second retaining member 162. The second retaining member 162 may be substantially straight along the longitudinal axis extending between the end surfaces 169. The planar surface 168 may be positioned facing head 148 so that the curved abutment surfaces 158 and 166 face one another. A washer 170 may be provided over shank 150 between head 148 and planar surface 168. Second retaining member 162 may have a width $W_5$ measured along a longitudinal axis thereof.

Figure 20:
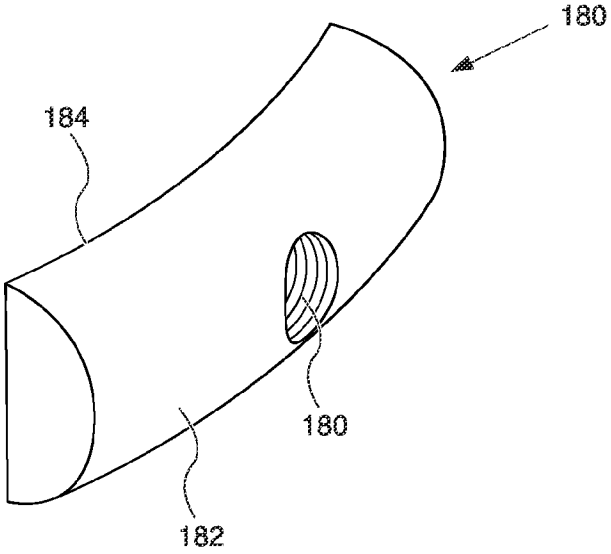
FIG. 20 is a perspective view of a second embodiment of the retaining member.

FIG. 20 depicts an alternate embodiment of a retaining member 180, which may be used in lieu of either or both of first retaining member 154 and second retaining member 162. Retaining member 180 is similar to retaining members 154 and 162, and includes a curved abutment surface 182. However, retaining member 180 is also curved along its longitudinal length, whereas the previously discussed retaining members 154, 162 are substantially straight in the longitudinal direction. Thus, retaining member 180 includes a rear surface 184 that is curved along its length about an axis generally perpendicular to the center axis of curved abutment surface 182 giving the retaining member 180 the general shape of a portion of a torus. A bore 186 extends through the retaining member 180, and the bore may be threaded.

Figure 21:
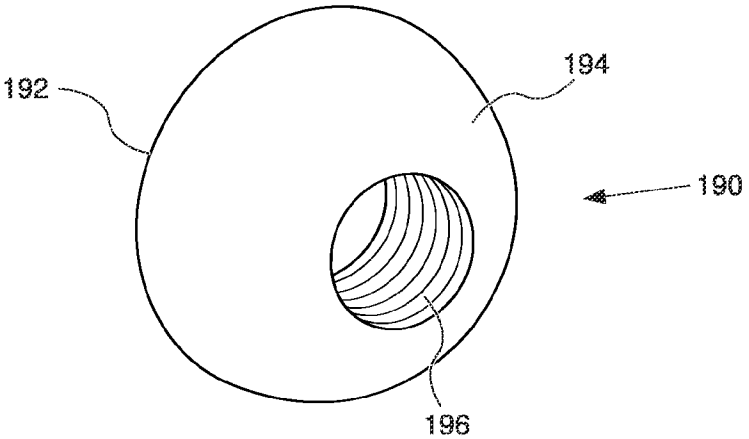
FIG. 21 is a perspective view of a third embodiment of the retaining member.

FIG. 21 depicts another alternate embodiment of a retaining member 190, which may be used in lieu of either or both of first retaining member 154 and second retaining member 162. Retaining member 190 includes a generally planar rear surface 192 that has a generally circular perimeter and a curved abutment surface 194 in the form of a semi-sphere extending from the perimeter of the rear surface 192. A bore 196 may extend through retaining member 190, and the bore 196 may be threaded.

INDUSTRIAL APPLICABILITY

The wear assembly 20 of the present disclosure may be applicable to any type of work tool that utilizes replaceable wear members. The wear assembly 20 of the present disclosure may be particularly applicable to an excavator bucket as protection for a bucket lip 12. Wear assembly 20 may be in the form of a shroud configured to be positioned between noses 16 of the bucket lip 12 extending forward from the bucket 10. Wear assembly 20, and tips and/or couplers secured over the noses 16, may be configured to protect the bucket lip 12 from abrasion caused by work material moving over and below the lip. It is also contemplated that the wear assembly of the present disclosure may be adapted to couple wear tips 18 to a nose 16 or intervening coupler.

Boss 26 may be welded or otherwise affixed to bucket lip 12. Retention system 24 may be configured to engage the wear member 22 and boss 26 and to provide a positive retention force securing the wear member 22 to the bucket lip 12. The inner faces of the first and second legs 72 and 74, including inner face 96 of first leg 72, may be configured to contact and engage the bucket lip 12 when the retention system is engaged.

The first and second retaining members 154 and 162 may be assembled onto fastener 140 prior to installation of wear member 22 onto bucket lip 12. Second retaining member 162 may be slid onto shank 150 at first end 144 by virtue of bore 164, and forced down shank 150 toward second end 146 until the planar surface 168 contacts head 148 or washer 170. First retaining member 154 may then be threaded onto threaded portion 152 of shank 150 with the threaded bore 156 engaging the threaded portion to prevent axial movement of the first retaining member 154 relative to fastener 140. The curved abutment surfaces 158 and 166 of the first and second retaining members 154 and 162 may generally face one another when mounted onto fastener 140. Rotation of the first retaining member 154 or fastener 140 relative to the other in a clockwise or counterclockwise direction may alternately shorten or increase the distance between the first retaining member 154 and second retaining member 162. Prior to installation the first retaining member 154 may be positioned proximate first end 144, thereby maximizing the distance between the first retaining member and second retaining member 162 to facilitate installation.

Referring to FIGS. 14-18, installation of the wear assembly 20 will be discussed. The first retaining member 154 of the retention system 24 may be positioned within the second pocket 120 of wear member 22. First retaining member 154 may fit within second pocket 120 with the curved abutment surface 158 of the first retaining member 154 contacting the curved abutment surface 128 of the second pocket 120. Shank 150 of fastener 140 is received within passage 132 and depression 130 may accommodate the end of shank 150. The curved interface formed by the curved abutment surfaces 158 and 128 and the passage 132 allow for pivoting of the retention system 24 relative to the wear member 22. The retention system 24 may be pivoted so that the second retaining member 162 and fastener 140 are moved upward toward the top surface 102 of first pocket 94. Recess 136 may allow for greater upward pivoting of fastener 140 and second retaining member 162 than would otherwise be possible due to interference from the top surface 102 of first pocket 94.

Figure 15:
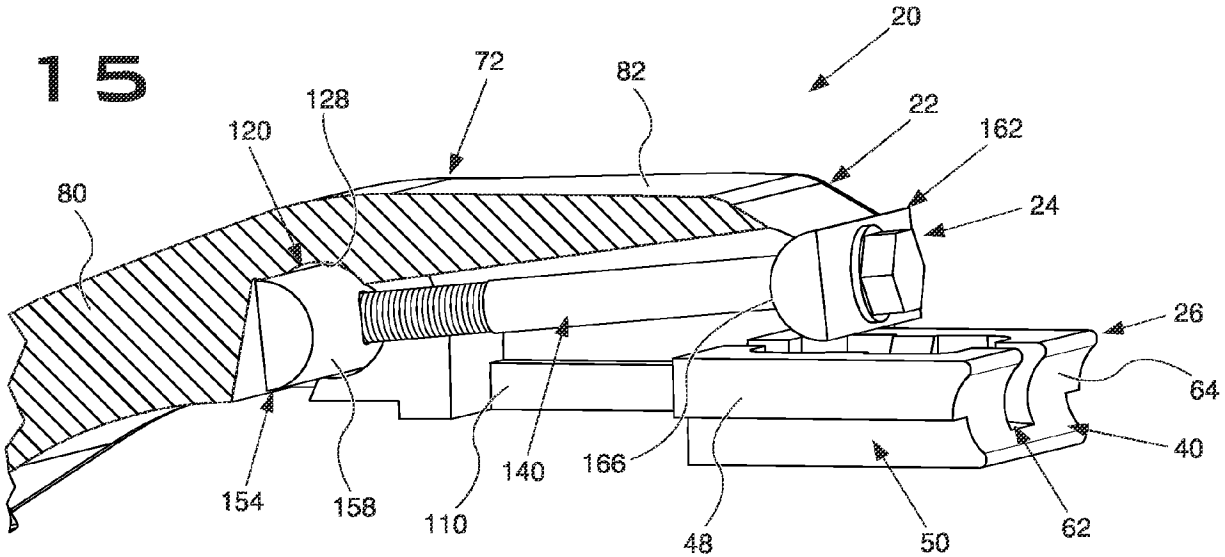
FIG. 15 is a fragmentary perspective cross section of the wear member assembly showing positioning of the wear member and retention assembly onto the boss.
Figure 16:
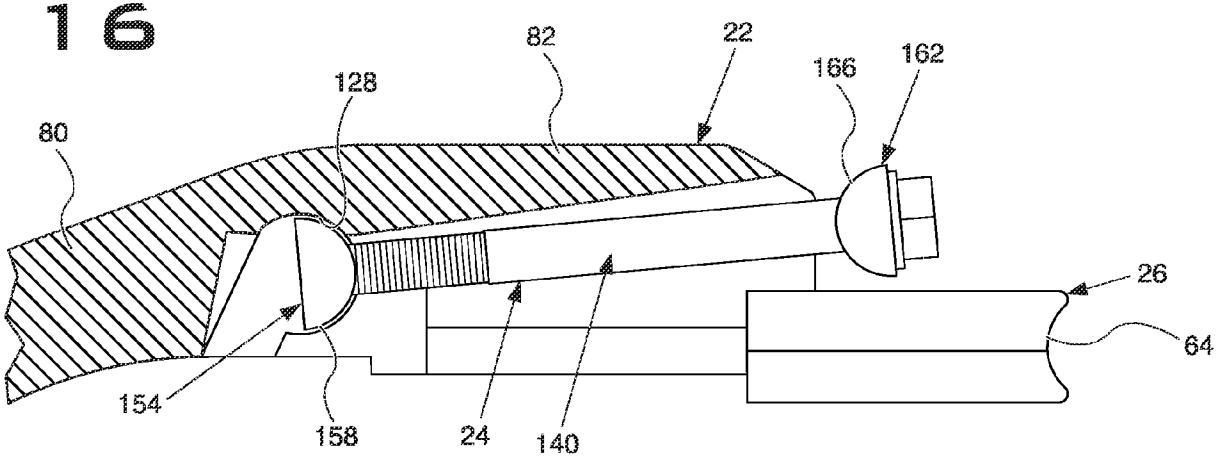
FIG. 16 is a fragmentary cross section of the wear member assembly similar to FIG. 13.
Figure 17:
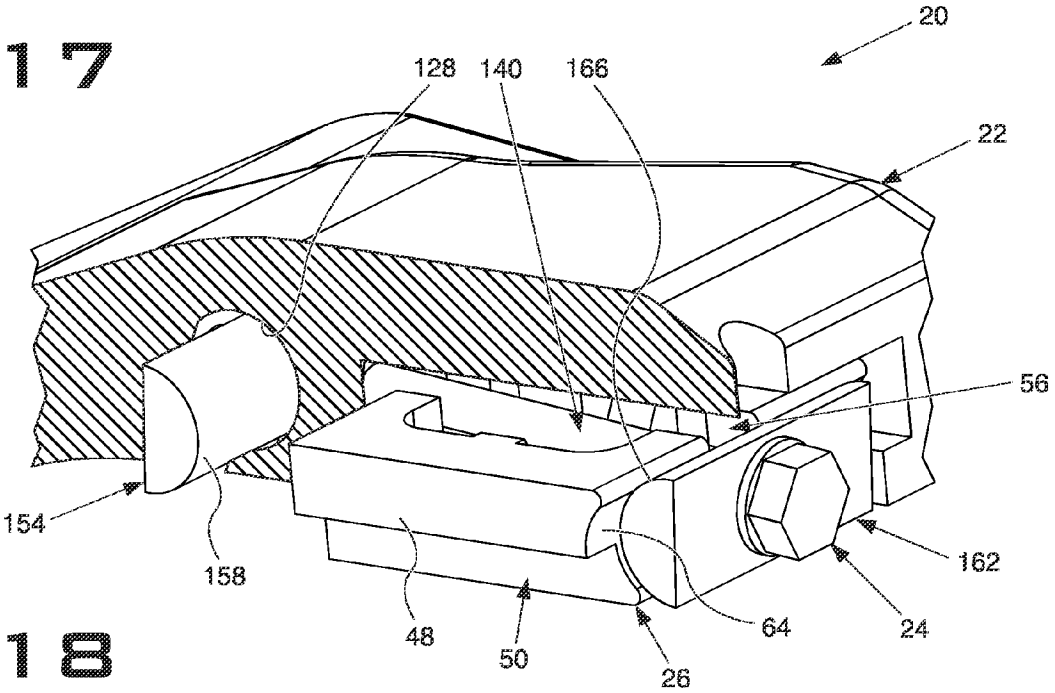
FIG. 17 is a fragmentary perspective cross section of the wear member assembly installed and secured to the boss.
Figure 18:
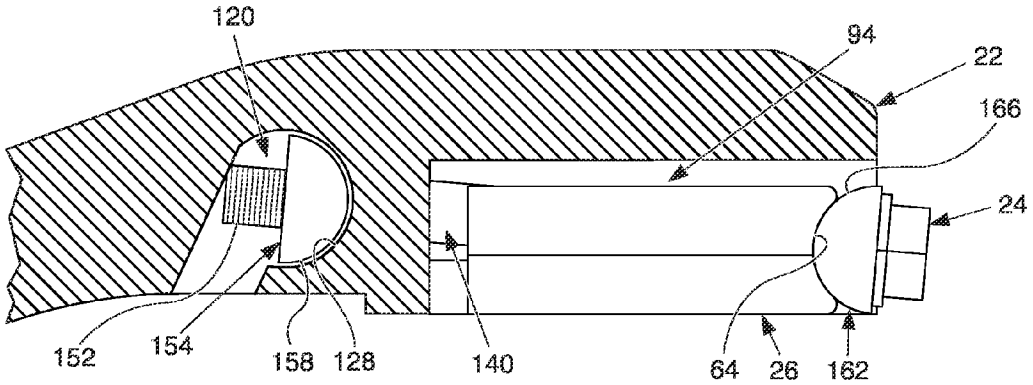
FIG. 18 is a fragmentary cross section of the wear member assembly similar to FIG. 17.

After retention system 24 has been pivoted upward, the wear member 22 may be positioned on the bucket lip 12, with boss 26 received in first pocket 94. The first and second shoulders 48 and 52 of the boss 26 may be received in the troughs 114 and 116 of the first pocket 94, and the first and second feet 110 and 112 of the first pocket 94 may likewise be received within the first and second slots 50 and 54 of the boss 26. The wear member 22 may be slid onto the bucket lip 12 until the front wall 38 of the boss 26 contacts the front surface 97 of the first pocket 94. The ability to pivot the retention system 24 upwardly relative to the wear member 22, as shown in FIGS. 15 and 16, allows for the boss 26 to be received into the first pocket 94 without interference.

Once the boss 26 is fully received in the first pocket 94, the retention system 24 may be pivoted downward so that the second retaining member 162 moves away from top surface 102 of first pocket 94. The fastener trough 56 in boss 26 receives the shank 150 of fastener 140 to allow the retention system 24 to be lowered fully for engagement between the second retaining member 162 and boss 26. Fastener 140 may be rotated relative to the first and second retaining members 154 and 162 to reduce the space therebetween, thereby engaging the retention system 24. When the fastener 140 is rotated, the curved abutment surface 166 of the second retaining member 162 may contact and engage the curved abutment surface 64 in the rear wall 40 of the boss 26. When installed, the longitudinal axis 142 of the fastener 140 may be oriented at an angle relative to the main axis 78 of the body 66 of wear member 22 so that the second retaining member 162 is positioned a greater distance from the plane of top surface 102 of first pocket 94 than first retaining member 154.

Removal of wear member 22 includes reversing the process discussed above for installation. The fastener 140 may be rotated to loosen retention system 24 and disengage the curved abutment surfaces 166 and 64, and the retention system may then be pivoted upward. The wear member 22 and retention system 24 may then be removed from bucket lip 12 and the retention system 24 subsequently removed from wear member 22.

Shank 150 of fastener 140 may have a diameter $W_1$ and passage 132 through partition wall 122 may have a width $W_4$. The diameter $W_1$ of shank 150 may be approximately equal to but less than the width $W_4$ of passage 132. First retaining member 154 may have a width between end surfaces 161 of $W_2$ and second pocket 120 may have a width $W_3$ measured between side surfaces 127. The width $W_2$ of first retaining member 154 may be approximately equal to but less than the width $W_3$ of second pocket 120. The second retaining member 162 may have a width $W_5$, and in a particular embodiment the width $W_5$ may be equal to the width $W_2$ of the first retaining member. Having a first retaining member 154 and second retaining member 162 of equal widths, and otherwise identical except for the threaded bore 156 in first retaining member 154, may allow for reductions in inventory and ease of manufacturing. In a particular embodiment, the ratio of the width $W_3$ of the second pocket to the width $W_4$ of the passage may be greater than 2.0. Similarly, the ratio of the width $W_2$ of the first retaining member 154 to the diameter $W_1$ of the shank 150 may be greater than 2.0.

The wear assembly 20 and retention system 24 of the present disclosure may provide numerous advantages as compared to known systems. The angle of the fastener 140 relative to the wear member 22 when installed provides a positive retention force on the wear member that pulls the wear member both back and down onto the bucket lip 12. Known systems may only provide a retention force in a direction away from the leading edge 14, and not down onto the bucket lip 12. Additionally, the threaded portion 152 of the fastener 140 is protected within the second pocket 120 in the wear member 22, which may alleviate problems with work material getting packed around the threads that can make loosening of the fastener 140 and removal of the wear member 22 more difficult.

Another benefit of the wear assembly 20 of the present disclosure may derive from the curved abutment surfaces 128, 158, 64 and 166. These curved abutment surfaces may reduce bending in the fastener 140 when the wear member 22 is under load. Furthermore, the wear assembly 20 of the present disclosure may allow for assembly of the retention system prior to installation of the wear member 22, making installation simpler and faster.

It will be apparent to those skilled in the art that various modifications and variations can be made to the wear assembly of the present disclosure without departing from the scope of the disclosure. Other embodiments will be apparent to those skilled in the art from consideration of the specification. It is intended that the specification and examples be considered as exemplary only, with a true scope of the disclosure being indicated by the following claims and their equivalent.

What is claimed is:

1. A wear member comprising:

a body including a leg having an inner face;

a first pocket formed in the inner face of the leg; and a second pocket formed in said inner face and spaced apart from the first pocket by a passage extending between the first pocket and the second pocket in a direction parallel to a main axis of the body, the second pocket including a curved abutment surface generally facing away from the first pocket, wherein the first pocket includes a front surface, opposing lateral side surfaces, a top surface extending between the opposing lateral side surfaces, an open bottom and an open rear.

2. The wear member of claim 1, wherein the first pocket includes laterally opposed feet extending inward from opposing lateral side surfaces, the feet defining longitudinally extending troughs.

3. The wear member of claim 1, wherein the open rear of the first pocket is formed in the rear surface of the body.

4. The wear member of claim 3, wherein a recess is formed in the top surface of the first pocket extending longitudinally from the passage to the rear surface.

5. The wear member of claim 4, wherein a depth of the recess is greater adjacent the rear surface than a depth of the recess adjacent the passage.

6. The wear member of claim 1, wherein the second pocket has a width $W_3$ and the passage has a width $W_4$, the ratio of the width $W_3$ of the second pocket to the width $W_4$ of the passage is greater than 2.0.

7. The wear member of claim 1, wherein the curved abutment surface of the second pocket extends laterally in a direction perpendicular to the main axis of the body.

8. The wear member of claim 1, wherein the curved abutment surface of the second pocket extends laterally outward on both sides of the passage.

9. The wear member of claim 1, wherein the curved abutment surface of the second pocket has a constant radius and extends at least 180° around a center axis.

10. The wear member of claim 1, wherein the curved abutment surface of the second pocket is concave.

11. A wear member comprising:

a body including a leg, the leg having an inner face defining a first pocket configured to receive a boss therein and a second pocket, the second pocket including a curved abutment surface generally facing the front end and having a width $W_3$; and a partition between the first and second pockets, the partition defining a passage between the first pocket and second pocket, the passage having a width $W_4$, wherein the ratio of the width $W_3$ of the second pocket to the width $W_4$ of the passage is greater than 2.0, and wherein the first pocket includes a front surface, opposing lateral side surfaces, a top surface extending between the opposing lateral side surfaces, an open bottom and an open rear.

* * * * *